US007665623B2

(12) United States Patent
Emmerzaal

(10) Patent No.: US 7,665,623 B2
(45) Date of Patent: Feb. 23, 2010

(54) CONTAINER TAB HAVING FLEXIBLE OPERATING PORTION

(75) Inventor: Ad Emmerzaal, Deventer (NL)

(73) Assignee: Impress Group B.V., Deventer (NL)

( * ) Notice: Subject to any disclaimer, the term of this patent is extended or adjusted under 35 U.S.C. 154(b) by 16 days.

(21) Appl. No.: 10/869,318

(22) Filed: Jun. 16, 2004

(65) Prior Publication Data

US 2005/0006389 A1 Jan. 13, 2005

Related U.S. Application Data

(63) Continuation of application No. 10/010,944, filed on Nov. 8, 2001, now abandoned.

(30) Foreign Application Priority Data

Nov. 10, 2000 (EP) ..... 00203965

(51) Int. Cl.
*B65D 17/34* (2006.01)

(52) U.S. Cl. ..... 220/269; 270/906

(58) Field of Classification Search ..... 220/269, 220/270, 906, 254.3, 271–273; 81/3.07, 81/3.4, 3.44, 3.27, 3.55; 215/305, 304; 413/25, 413/14, 16

See application file for complete search history.

(56) References Cited

U.S. PATENT DOCUMENTS

| | | | | |
|---|---|---|---|---|
| 1,856,543 | A * | 5/1932 | Ericsson | 220/270 |
| 3,221,924 | A * | 12/1965 | Harvey et al. | 220/231 |
| 3,301,431 | A | 1/1967 | Rau et al. | |
| 3,337,085 | A * | 8/1967 | Bozek | 220/270 |
| 3,961,722 | A * | 6/1976 | Bozek | 220/270 |
| 4,463,866 | A * | 8/1984 | Mandel | 220/269 |
| 5,555,778 | A * | 9/1996 | Otters et al. | 81/3.55 |
| 5,699,928 | A | 12/1997 | Chung et al. | |
| 5,916,337 | A | 6/1999 | Caniglia et al. | |
| 6,575,325 | B2 | 6/2003 | Dickie et al. | |

FOREIGN PATENT DOCUMENTS

| | | | |
|---|---|---|---|
| FR | 1130591 | | 2/1957 |
| JP | 5-305945 | | 11/1993 |
| JP | 8-119276 | | 5/1996 |
| JP | 9-290827 | A * | 11/1997 |
| JP | 411139429 | A * | 5/1999 |
| JP | 11-342941 | | 12/1999 |
| JP | P2000-128167 | A | 5/2000 |
| WO | WO 98/588478 | A1 | 12/1998 |

* cited by examiner

*Primary Examiner*—Robin A. Hylton
(74) *Attorney, Agent, or Firm*—The Webb Law Firm

(57) ABSTRACT

A tab for use with a container includes a rigid lever part, wherein the rigid lever is connectable to a tear part of the container and an operating part for operating the lever part. The operating part is movably connected to the lever part, such that the operating part can be moved out of the plane of the rigid lever part.

5 Claims, 6 Drawing Sheets

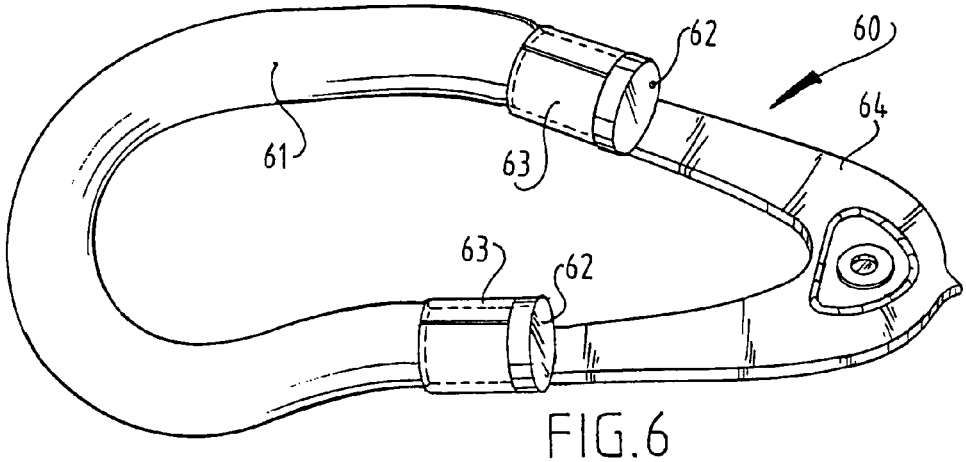
FIG.6
FIG.8
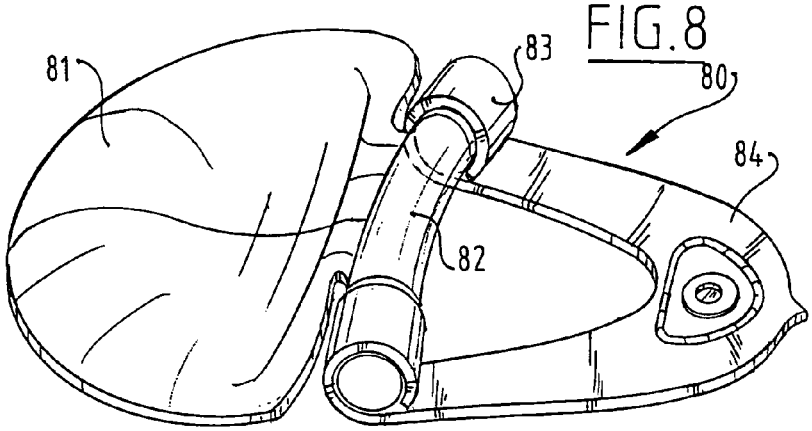
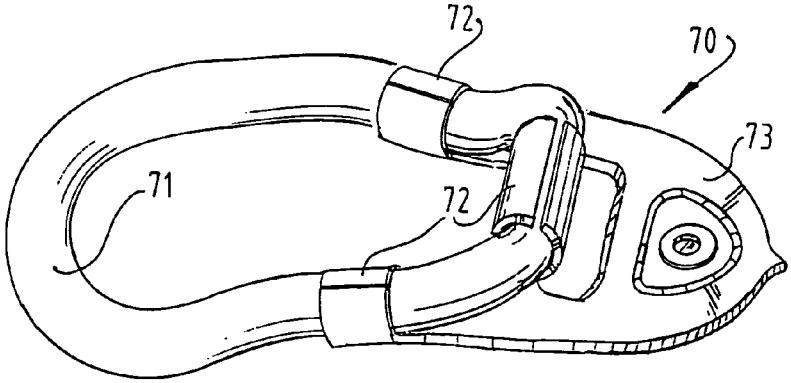
FIG.7

CONTAINER TAB HAVING FLEXIBLE OPERATING PORTION

BACKGROUND OF THE INVENTION

1. Field of the Invention

The invention relates to a tab for a container, which container comprises a wall with a tear part for opening the container, such as containers with an easy opening end.

2. Description of the Prior Art

Conventional containers with a tear part have a tab for popping the tear part and subsequently tearing the tear part out of the wall of the container in which the tear part is arranged. The removal of the tear part leaves an opening, through which the contents of the container can be accessed.

The performance of a tab is currently measured with two values. The first value is the pop force. This pop force is the force necessary to press a tab end against the tear part, such that the tear part begins to tear and the opening arises. The second value is the tear force. This tear force is the force necessary to tear the tear part fully out. Both the pop force and the tear force are currently fully optimized.

However, users of containers with an easy opening end still have trouble opening the container. It turns out that the initial force for lifting the tab of the surface of the container contributes considerably to the comfort of opening a container with an easy opening end. At present a tab is adjacent to the surface of the container. It is therefore difficult to get a grip onto the tab in order to lift the tab and open the container. The force necessary to lift the tab from the surface is called the first lift force. In order to improve comfort of such a tab, the first lift force could be reduced, or the access to the tab in order to grab it could be improved.

It is an object of the present invention to provide a tab with improved comfort for opening a container.

BRIEF SUMMARY OF THE INVENTION

This object is achieved by a tab according to the invention, which comprises:

- a rigid lever part, which is connectable to the tear part; and
- an operating part for operating the lever part, which operating part is movably connected to the lever part, such that the operating part can be moved out of the plane of the rigid lever part.

Because the operating part is movably connected to the lever part, such that the operating part can be moved out of the plane of the rigid lever part, it is possible to tilt part of the tab up, without already exerting the first lift force. When one has a firm grip onto the operating part, one can exert the necessary first lift force to lift the tab and subsequently to exert pop force to pop the tear part and subsequently exert a tear force in order to tear the tear part out of the wall of the container.

According to an embodiment of the invention the operating part is hingedly arranged to the lever part. Such an operating part can be folded up without any major effort, after which one can get a good grip on the operating part in order to pop and tear the tear part.

Preferably the lever part comprises a substantially sleeve-like edge, in which a cylindrical edge of the operating part is hingedly arranged. This has the advantage that during manufacturing the operating part can be snapped into the lever part.

In another embodiment of the invention the lever part comprises at least one opening, in which the operating part is arranged. A loop-like part can be arranged in said opening or for example a nail shaped part can be arranged in said opening.

Preferably the operating part has a tab shape.

In another embodiment the operating part comprises a loop.

According to again another embodiment of the invention the operating part is flexible. Instead of hingedly arranged, the operating part can be flexible, such that the operating part can be lifted without already popping the tear part.

Preferably the lever part comprises at least two sleeves, in which the ends of a strand are fixedly arranged. Hereby the strand forms a loop in which a finger can be placed and by which a tear force can easily be exerted. The strand comprises preferably a plastic. This plastic can be, for example, polypropylene or nylon 6.6.

In another embodiment the strand comprises a cable of metal, plastic etc. This cable provides the strength for enabling a sufficient tear force.

The invention also relates to a container, comprising:

- a bottom wall:
- a peripheral wall extending from the bottom wall;
- an upper closing wall, which comprises a tear part for opening the container; and
- a tab according to the invention, which is connected to the tear part.

These and other characteristics of the invention are further disclosed hereafter in combination with the attached drawings.

BRIEF DESCRIPTION OF THE SEVERAL VIEWS OF THE DRAWINGS

FIGS. 3-7 show embodiments of a tab according to the invention, in which the operating part is flexible.

FIGS. 8-13 show embodiments of a tab, in which the operating part is hingedly arranged to the lever part.

DETAILED DESCRIPTION OF THE INVENTION

Figure 1A:
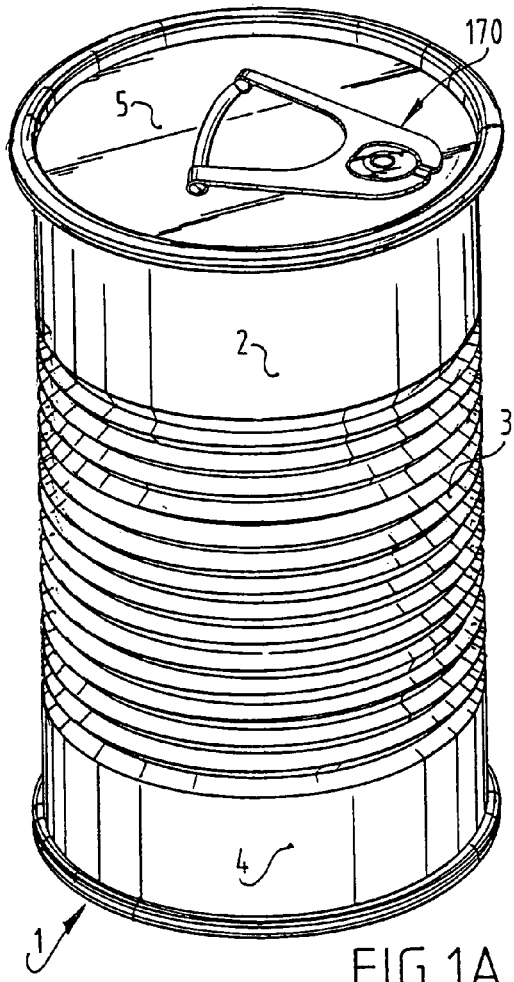
FIGS. 1A and 1B show in perspective view two embodiments of a container according to the invention.

FIG. 1A shows a first embodiment 1 of a container according to the invention. This container is a so-called three part container, which has a peripheral wall 2, 4 with a corrugated part 3. Onto the upper wall 5 a tab 170 is arranged, which tab 170 will be discussed in relation to FIG. 17.

Figure 1B:
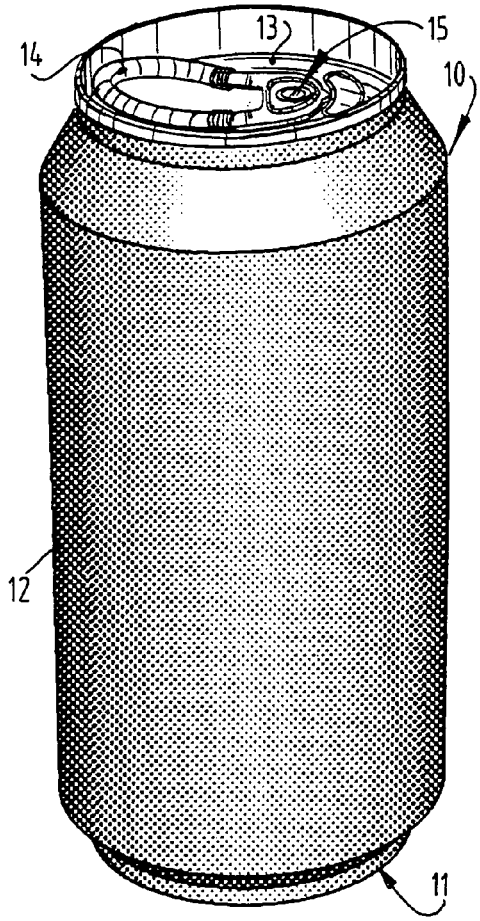

FIG. 1B shows a second embodiment 10 of a container according to the invention. This container comprises a bottom wall 11, a peripheral wall 12 and an upper closing wall 13. Onto the upper closing wall 13 is a tab 14 arranged, which is shown in more detail in FIG. 3. This tab is arranged to said upper closing wall 13 with a rivet 15.

Figure 2:
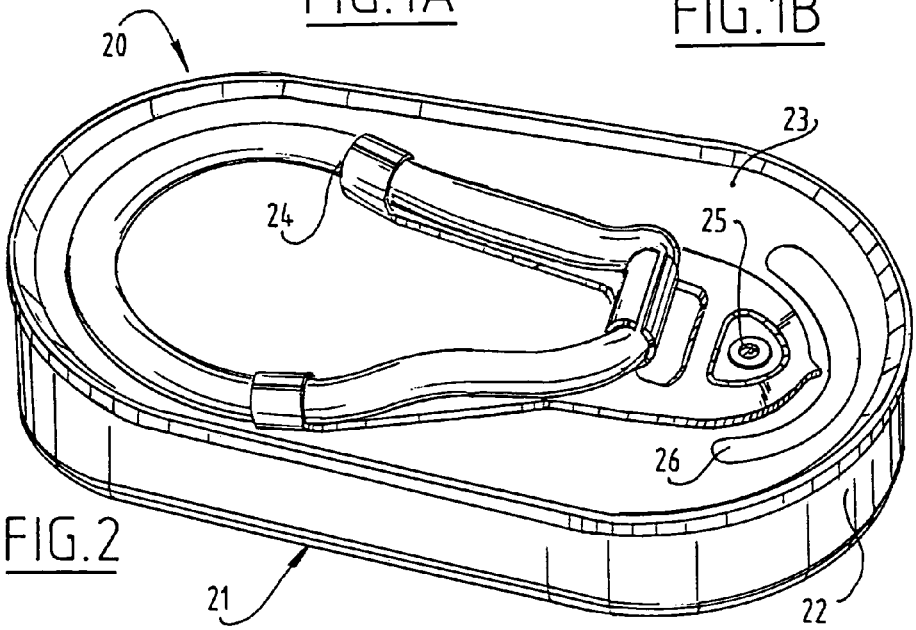
FIG. 2 shows in perspective view a second embodiment of a container according to the invention.

FIG. 2 shows a third embodiment 20 of a container according to the invention. This embodiment 20 also comprises a bottom wall 21, a peripheral wall 22 and an upper closing wall 23. Onto the upper closing wall 23 a tab 24, which is shown in more detail in FIG. 7, is arrange with a rivet 25. In order to define the pop area of the tear part, which comprises the whole surface of the upper closing wall 23, a strengthening groove 26 is arranged into the upper closing wall 23.

Figure 3:
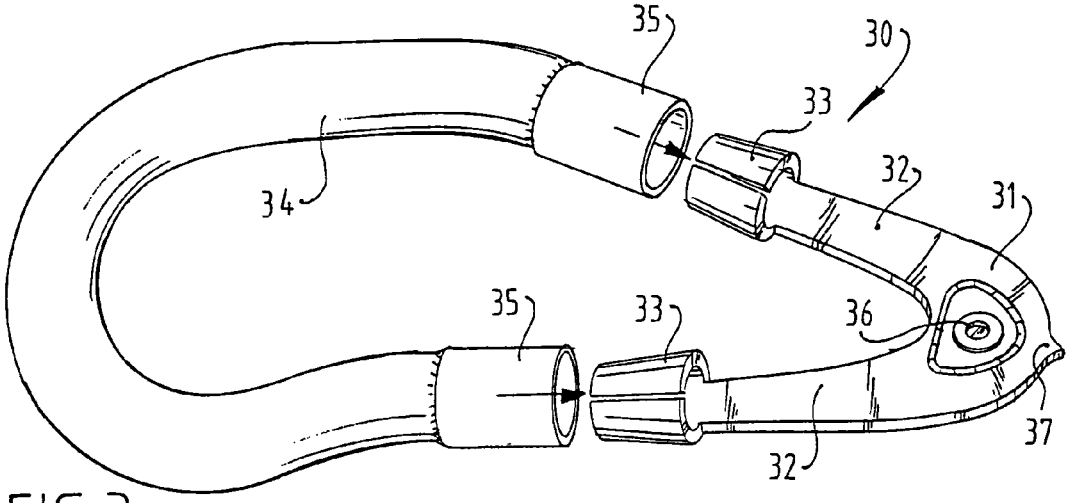

FIG. 3 shows a first embodiment 30 of a tab according to the invention. The tab 30 comprises a lever part 31 with two legs 32. These legs 32 comprise sleeve-like ends 33. In this embodiment these sleeve-like parts are conical. The tab 30 further comprises an operating part, which comprises a strand 34, which has on each end a bushing 35, which is shifted over the sleeves 33. The lever part 31 is arranged with a rivet 36 to a tear part of a container. This rivet functions as a pivot for the levering action of the lever part 31. By pulling up the legs 32, the front part 37 of the lever part 31 will be pressed against the tear part and realizes the pop force for popping the tear part.

Figure 4:
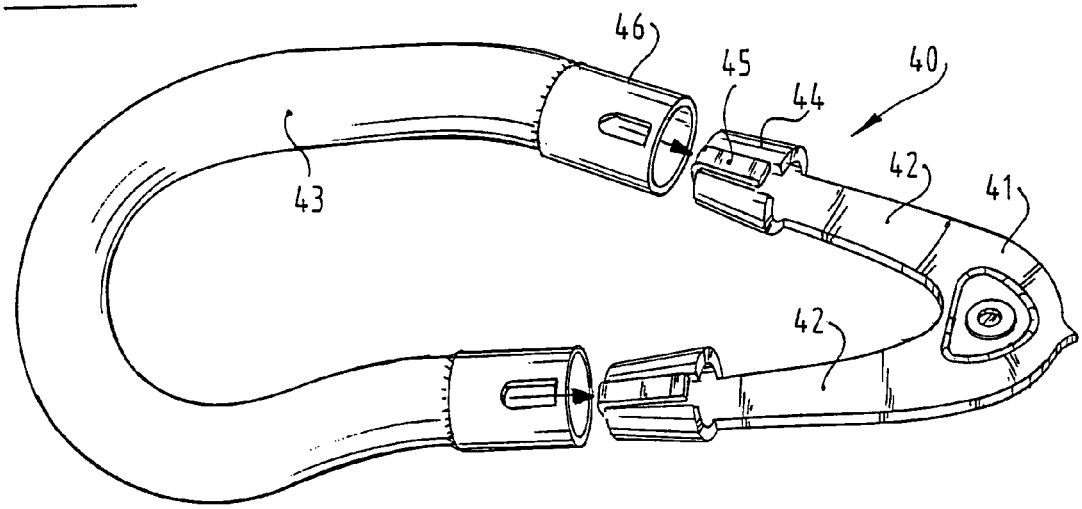

FIG. 4 shows a second embodiment 40 of a tab according to the invention. Similar to the embodiment 30 this embodiment has also a lever part 41 with two legs 42 and an operating part 43. Onto the legs 42 are sleeve-like ends 44 arranged. These sleeve-like ends are conical and comprise a lip 45, which co-acts with an opening in the bushings 46 for securing the sleeve-like ends 44 into the bushings 46.

Figure 5:
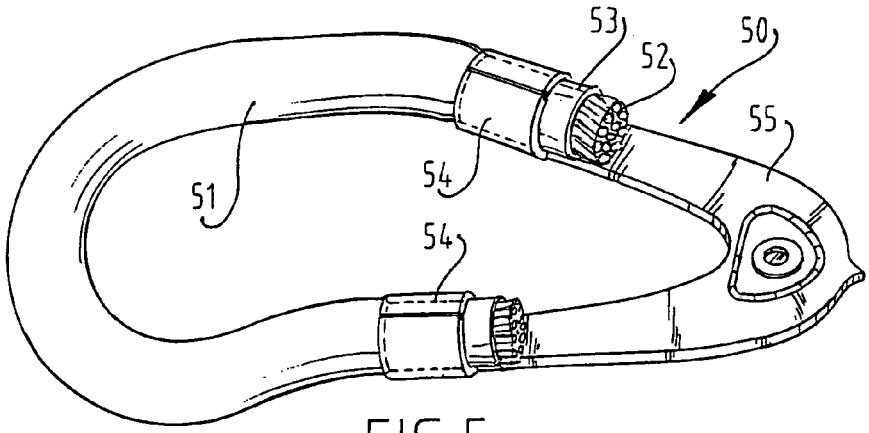

FIG. 5 shows a third embodiment 50 of a tab according to the invention. In this embodiment the operating part 51 comprises a metal cable 52, which is coated with a plastic layer 53. The operating part 51 is clammed into sleeves 54 arranged onto the lever part 55.

FIG. 6 shows a fourth embodiment 60 of a tab according to the invention. In this embodiment the operating part, which consists of a strand 61, has two thickenings 62 on both ends of the strand 61. These thickenings 62 prevent that the strand 61 from being pulled through the sleeves 63 of the lever part 64.

FIG. 7 shows a fifth embodiment 70 of a tab according to the invention. In this embodiment an O-ring 71 is used as operating part. This O-ring 71 is clammed into three sleeve parts 72 of the lever part 73.

FIG. 8 shows a sixth embodiment 80 of a tab according to the invention. This tab 80 comprises a tab-shaped operating part 81, which comprises two journals 82, which are hingedly arranged into sleeve-like ends 83 of the lever part 84.

Figure 9:
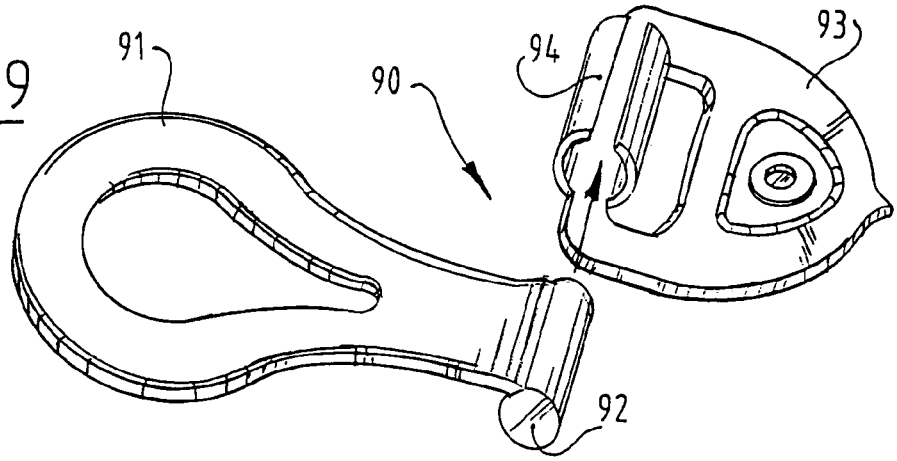

FIG. 9 shows a seventh embodiment 90 of a tab according to the invention. This tab 90 comprises a loop-like operating part 91 with a cylindrical edge 92. The lever part 93 comprises a sleeve-like edge 94 in which the cylindrical edge 92 can be shifted.

Figure 10:
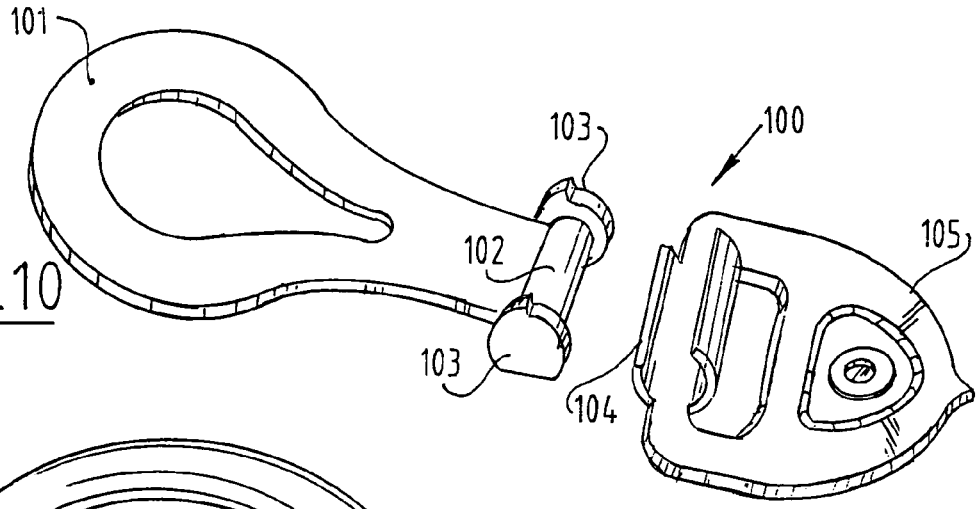

FIG. 10 shows an eighth embodiment 100, which is similar to the seventh embodiment 90. The operating part 101 again comprises a cylindrical edge 102, which has on both ends two thickenings 103. This cylindrical edge 102 can be snapped into a halve open sleeve part 104 of the lever part 105. The thickenings 103 prevent the operating part 101 from shifting out of the halve open sleeve 104. The thickenings 103 comprise a peripheral ridge, which defines an angular end position of the operating part 101 relative to the lever part 105.

Figure 11:
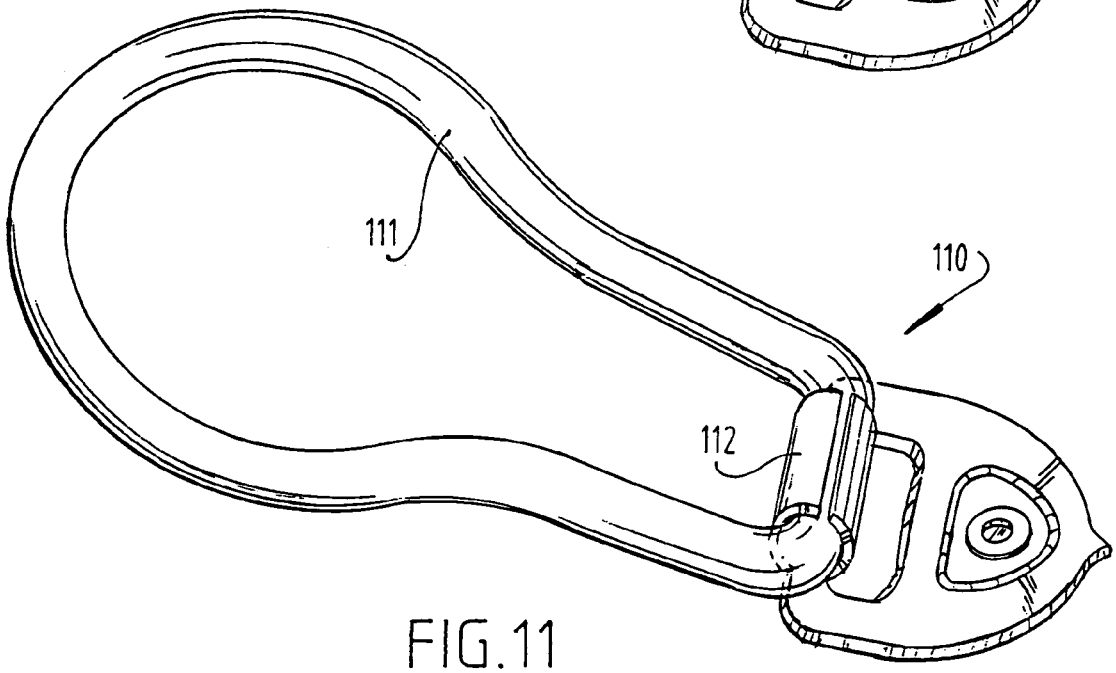

FIG. 11 shows a ninth embodiment of a tab according to the invention. This embodiment 110 has also an O-ring 111, but is held in just one sleeve-like edge 112.

Figure 12:
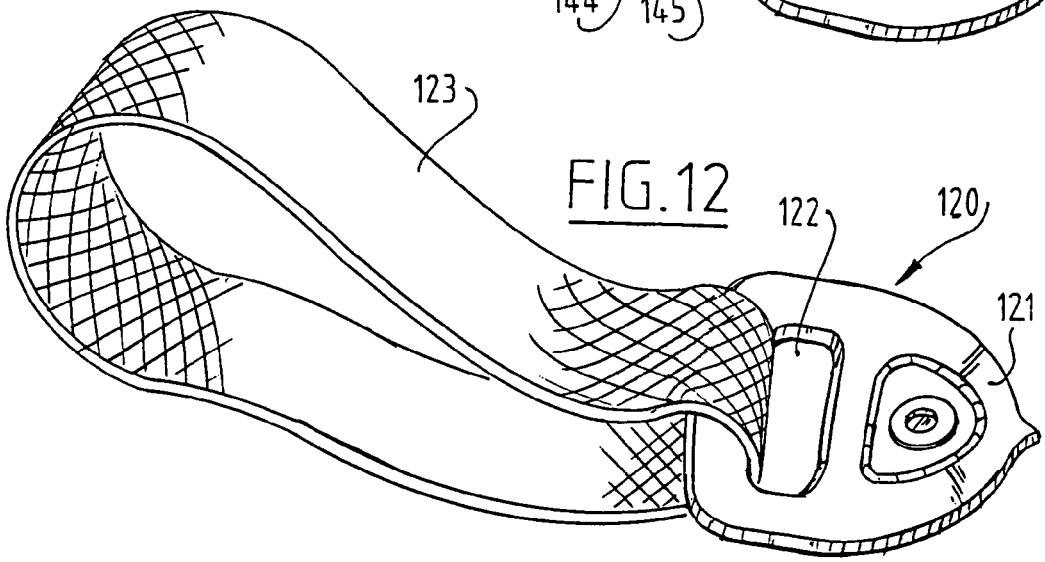

FIG. 12 shows a tenth embodiment 120 of a tab according to the invention. This embodiment 120 comprises a lever part 121 with an opening 122. A loop-like ribbon 123 extends through the opening 122 of the lever part 121.

Figure 13:
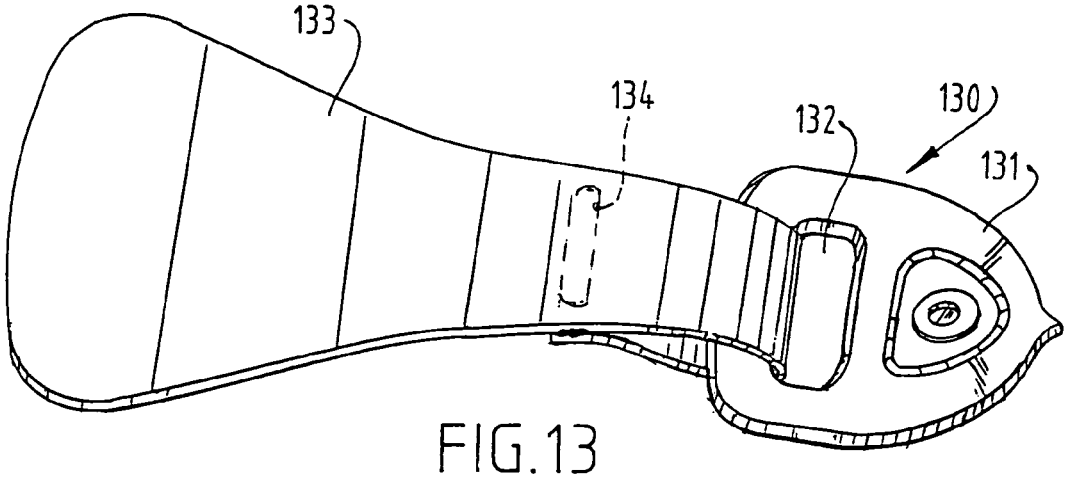

FIG. 13 shows an eleventh embodiment of a tab 130 according to the invention, which comprises again a lever part 131 with an opening 132. A tab-like operating part 133 extends with one end through the opening 132 and is looped back and attached to itself with an attachment zone 134.

Figure 14:
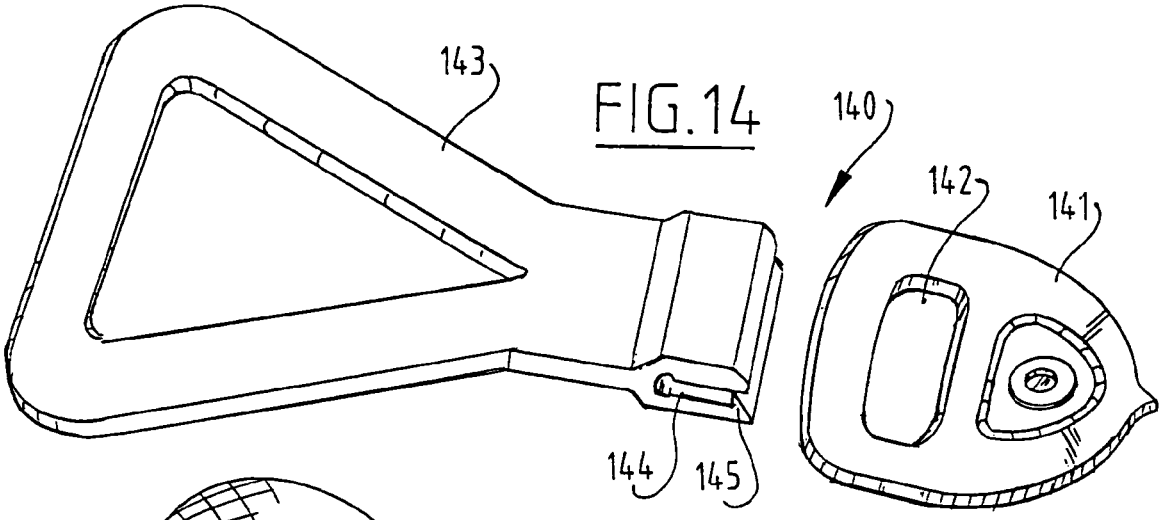
FIGS. 14-16 show embodiments of a tab, in which the operating part is snapped onto the lever part.

FIG. 14 shows a twelfth embodiment 140 of a tab according to the invention. This embodiment 140 has a lever part 141 with an opening 142. The operating part 143 has an end with a slot 144, which can be shifted over the lever part 141. The slot 144 comprises also a container 145, which locks the operating part 143 onto the lever part 141.

Figure 15:
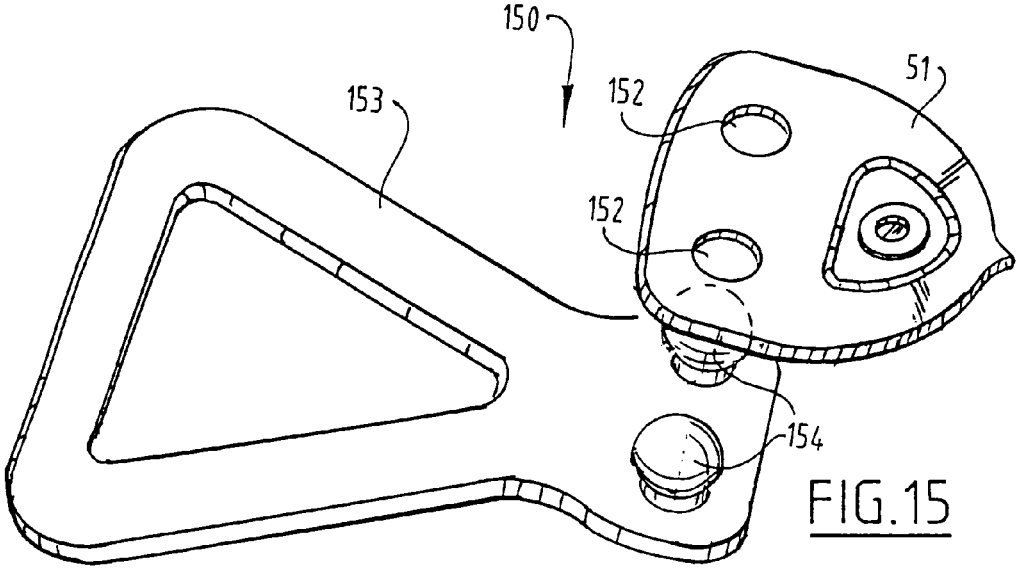

FIG. 15 shows a thirteenth embodiment 150 of a tab according to the invention. In this embodiment the lever part 151 is provided with two openings 152. The operating part 153 comprises two mushroom-like protrusions 154, which can be snapped into the openings 152.

Figure 16:
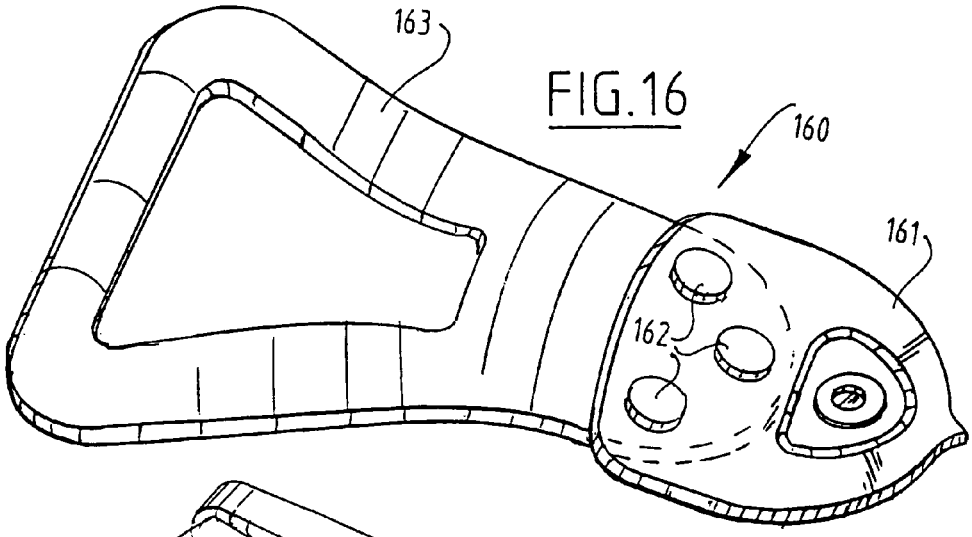

FIG. 16 shows a fourteenth embodiment 160 of a tab according to the invention. In this embodiment the lever part 161 is provided with three openings through which three protrusions 162 of the operating part 163 extend and are caulked.

Figure 17:
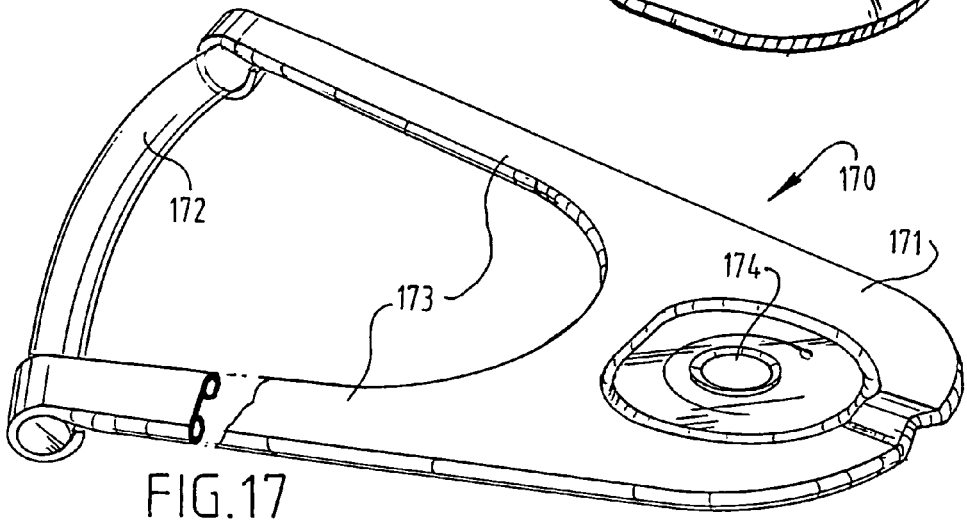
FIG. 17 shows a preferred embodiment of a tab according to the invention.

FIG. 17 shows a preferred embodiment of a tab 170 according to the invention. This tab comprises a lever part 171 and an operating part 172. The lever part comprises two legs 173, which are connected to the operating part 172. The lever part comprises an opening 174, through which a rivet may extend in order to mount the tab onto a container. The lever part 171 is made out of a piece of rigid material like metal, tin plate or aluminum. The operating part 172 can be made out of a plastic, and elastic strength.

The invention claimed is:

1. A tab for a container having a wall with a tear part for opening the container, said tab comprising:

a rigid lever part, which is connectable to the tear part and which defines a plane, wherein the lever part includes a lever front part which, during operation of the rigid lever part, is pressed against the tear part; and a flexible operating part for operating the lever part, wherein the operating part is movably connected to the lever part, such that the operating part is adapted to be moved out of the plane of the rigid lever part without exerting a first lift force to the lever front part and subsequent pressing of the lever front part against the tear part of the container, wherein the lever part includes two legs having respective free ends extending away from the lever front part, the two legs having a first sleeve and a second sleeve, the first sleeve is coupled to one of the free ends of the two legs and the second sleeve is coupled to the other free end of the two legs, and further wherein the flexible operating part is a cable having a first end and a second end, the first end of the cable is fixedly arranged in the first sleeve and the second end of the cable is fixedly arranged in the second sleeve.

2. The tab according to claim 1, wherein the operating part is a plastic cable.

3. The tab according to claim 1, wherein the operating part is a steel cable.

4. A container, comprising:

a bottom wall;

a peripheral wall extending from the bottom wall;

an upper closing wall, which comprises a tear part for opening the container;

a tab which is connected to the tear part, wherein the tab is comprised of a rigid lever part, which is connectable to the tear part and which defines a plane, wherein the lever part includes a lever front part which, during operation of the rigid lever part, is pressed against the tear part; and a flexible operating part for operating the lever part, wherein the operating part is movably connected to the lever part, such that the operating part is adapted to be moved out of the plane of the rigid lever part without exerting a first lift force to the lever front part and subsequent pressing of the lever front part against the tear part of the container, wherein the lever part includes two legs having respective free ends extending away from the lever front part, the two legs having a first sleeve and a second sleeve, the first sleeve is coupled to one of the free ends of the two legs and the second sleeve is coupled to the other free end of the two legs, and further wherein the flexible operating part is a cable having a first end and a second end, the first end of the cable is fixedly arranged in the first sleeve and the second end of the cable is fixedly arranged in the second sleeve.

5. A tab for a container having a wall with a tear part for opening the container, said tab comprising:

a rigid lever part, which is connectable to the tear part and which defines a plane, wherein the lever part includes a lever front part which, during operation of the rigid lever part, is pressed against the tear part; and a flexible operating part for operating the lever part, wherein the operating part is movably connected to the lever part, such that the operating part is adapted to be moved out of the plane of the rigid lever part without causing the lever front part of the rigid lever part to pop the tear part of the wall of the container, wherein the lever part includes two legs having respective free ends extending away from the lever front part, the two legs having a first sleeve and a second sleeve, the first sleeve is coupled to one of the free ends of the two legs and the second sleeve is coupled to the other free end of the two legs, and further wherein the flexible operating part is a cable having a first end and a second end, the first end of the cable is fixedly arranged in the first sleeve and the second end of the cable is fixedly arranged in the second sleeve.

* * * * *